US005546173A

United States Patent [19]

Hinotani et al.

[11] Patent Number: 5,546,173

[45] Date of Patent: Aug. 13, 1996

[54] FIXING DEVICE

[75] Inventors: Hiroaki Hinotani; Yasuhiro Matsuura, both of Toyokawa, Japan

[73] Assignee: Minolta Co., Ltd., Osaka, Japan

[21] Appl. No.: 355,196

[22] Filed: Dec. 8, 1994

[30] Foreign Application Priority Data

Dec. 14, 1993 [JP] Japan ..... 5-313437

[51] Int. Cl.[6] ..... G03G 15/20

[52] U.S. Cl. ..... 355/282; 355/285; 492/28; 492/48

[58] Field of Search ..... 492/28, 46, 48, 492/49, 53, 56; 355/282, 285, 289, 290; 432/60; 219/216

[56] References Cited

U.S. PATENT DOCUMENTS 5,355,203 10/1994 Nishikawa et al. ..... 355/285

FOREIGN PATENT DOCUMENTS 1-191882 8/1989 Japan .
4-559 1/1992 Japan .
4-244871 9/1992 Japan .

*Primary Examiner*—R. L. Moses
*Attorney, Agent, or Firm*—Burns, Doane, Swecker & Mathis, L.L.P.

[57] ABSTRACT

A fixing device having a pair of rollers which rotate with pressure contacting each other so as to fix an unfixed toner image onto a sheet by passing the sheet therebetween. At least one of the roller has at least one end portion on a peripheral surface thereof which is formed by a material having a coefficient of friction greater than that of a rest portion of the peripheral surface, thereby the slip caused between the rollers is prevented.

9 Claims, 5 Drawing Sheets

FIXING DEVICE

BACKGROUND OF THE INVENTION

FIELD OF THE INVENTION

The present invention relates to a fixing device which fixes an unfixed toner image onto a sheet, and more particularly, relates to a fixing device which fixes an unfixed toner image onto a sheet by passing the sheet having an unfixed toner image thereon between a fixing roller and a pressure roller which rotate with pressure contacting each other.

DESCRIPTION OF THE RELATED ART

In an image forming apparatus such as a copier, printer or the like, which forms an image on a sheet by an electrophotographic process, an unfixed toner image is generally fixed to a sheet by passing a sheet having an unfixed toner image thereon between a fixing roller and a pressure roller which rotate with pressure contacting each other.

In a fixing device as described above, the surface of a roller is covered with fluorine, silicone resin or rubber which has excellent separability so as to reduce the adhesive power of toner and the absorption power of a sheet to both rollers.

In a general fixing device, one roller is driven and the other roller pressure contacts the one roller to be rotated by the driven roller. Therefore, the usage of a roller of excellent separability, that is, a roller having a low coefficient of friction causes slippage between the rollers, and results in disorder of an image on a sheet.

OBJECTS AND SUMMARY

A main object of the present invention is to provide a fixing device which does not cause disorder of an image.

Another object of the present invention is to provide a fixing device which does not cause slippage between rollers, even if the rollers have excellent separability.

The objects of the present invention are achieved by providing a fixing device comprising a rotatable first roller and a second roller rotatable with pressure contacting said first roller so as to fix an unfixed toner image onto a sheet by passing the sheet between the first and second rollers, wherein at least one of said first and second rollers has at least one end portion on a peripheral surface thereof which is formed by a material having a coefficient of friction greater than that of a remaining portion of the peripheral surface.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiment of a fixing device of the present invention is described hereinafter which is applied to a laser beam printer.

Figure 1:
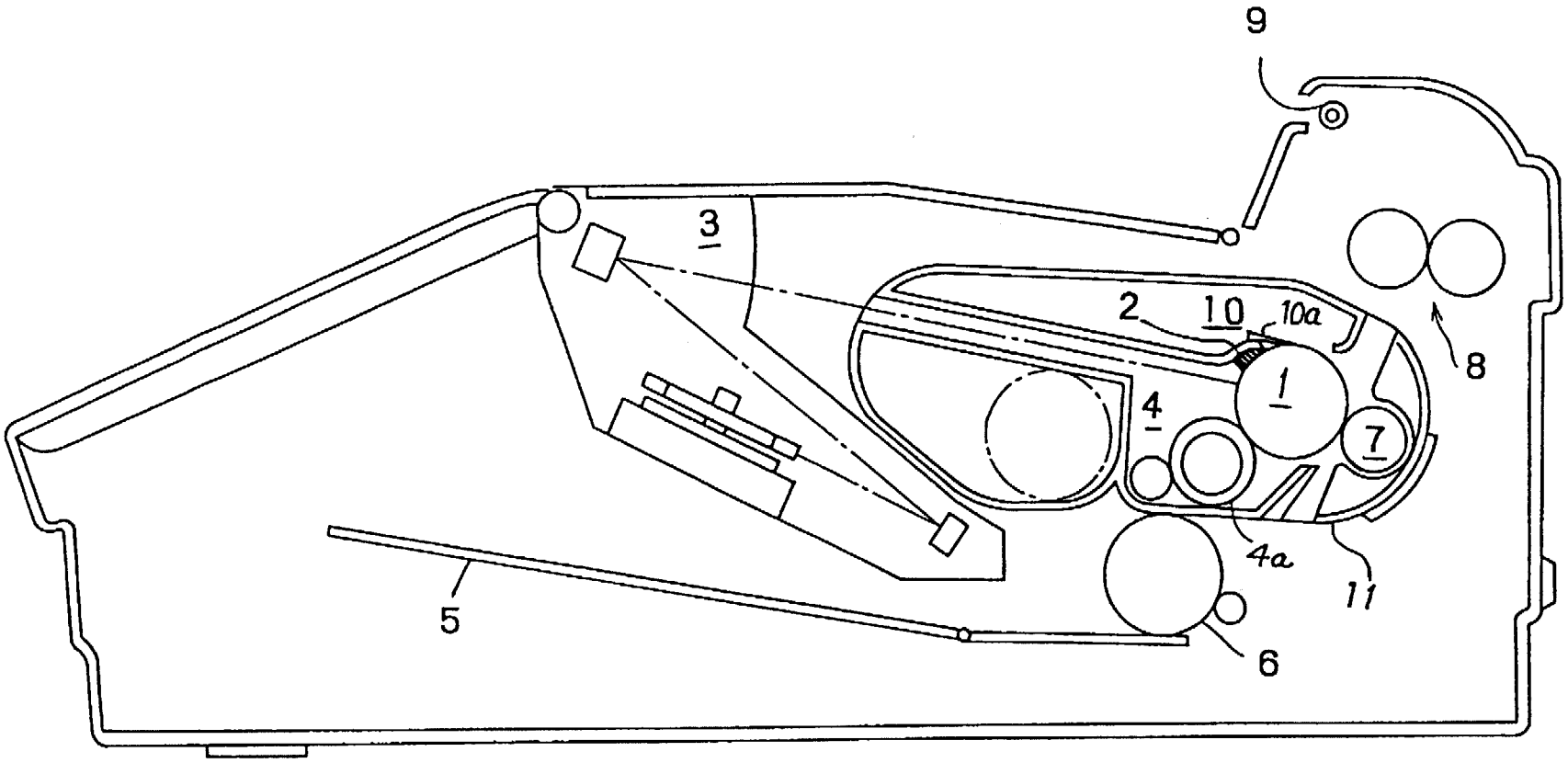
FIG. 1 is an illustration showing a general construction of a laser beam printer providing a fixing device of the present invention.

FIG. 1 is a cross section view showing a construction of a laser beam printer which forms an image by an electrophotographic process.

A photosensitive drum 1 is driven in a counterclockwise direction. The surface of the photosensitive drum 1 is charged to a predetermined potential by a charge brush 2, and is then exposed by a laser beam which is sent from a print head 3 and modulated in accordance with an image signal of an image to be printed. The laser beam forms an electrostatic latent image on the photosensitive drum 1. This electrostatic latent image is developed with toner by passing the sheet by a developing sleeve **4*a* of a developing device 4**.

Sheets are accommodated on a feeding tray 5 which is provided at a bottom portion of a main body, and are fed one by one by rotational drive of a feeding roller 6 provided at a tip portion of the feeding tray 5. A fed sheet is transported to a nip portion formed between the photosensitive drum 1 and a transfer roller 7 along a sheet path. The transfer roller 7 is biased to a polarity opposite to that of the photosensitive drum 1 by a bias power source to transfer the toner image formed on the photosensitive drum 1 onto the sheet. The sheet onto which the toner image has been transferred is sent to a fixing device 8 so as to fix the toner image thereon. The sheet is then discharged onto an upper surface of the printer by a discharge roller 9.

After the image is transferred to the sheet, the photosensitive drum 1 continues to rotate in the counterclockwise direction in the drawing, and residual toner on the surface thereof is scraped by a blade **10*a* of a cleaner 10. The surface is then charged again by the charge brush 2. The toner scraped by the cleaner blade 10*a* is accommodated in an accommodation space inside the cleaner 10**.

The aforementioned photosensitive drum 1, charge brush 2, developing device 4, transfer roller 7 and cleaner 10 are integrated as an imaging cartridge 11 which is detachable from the image forming apparatus.

Figure 2:
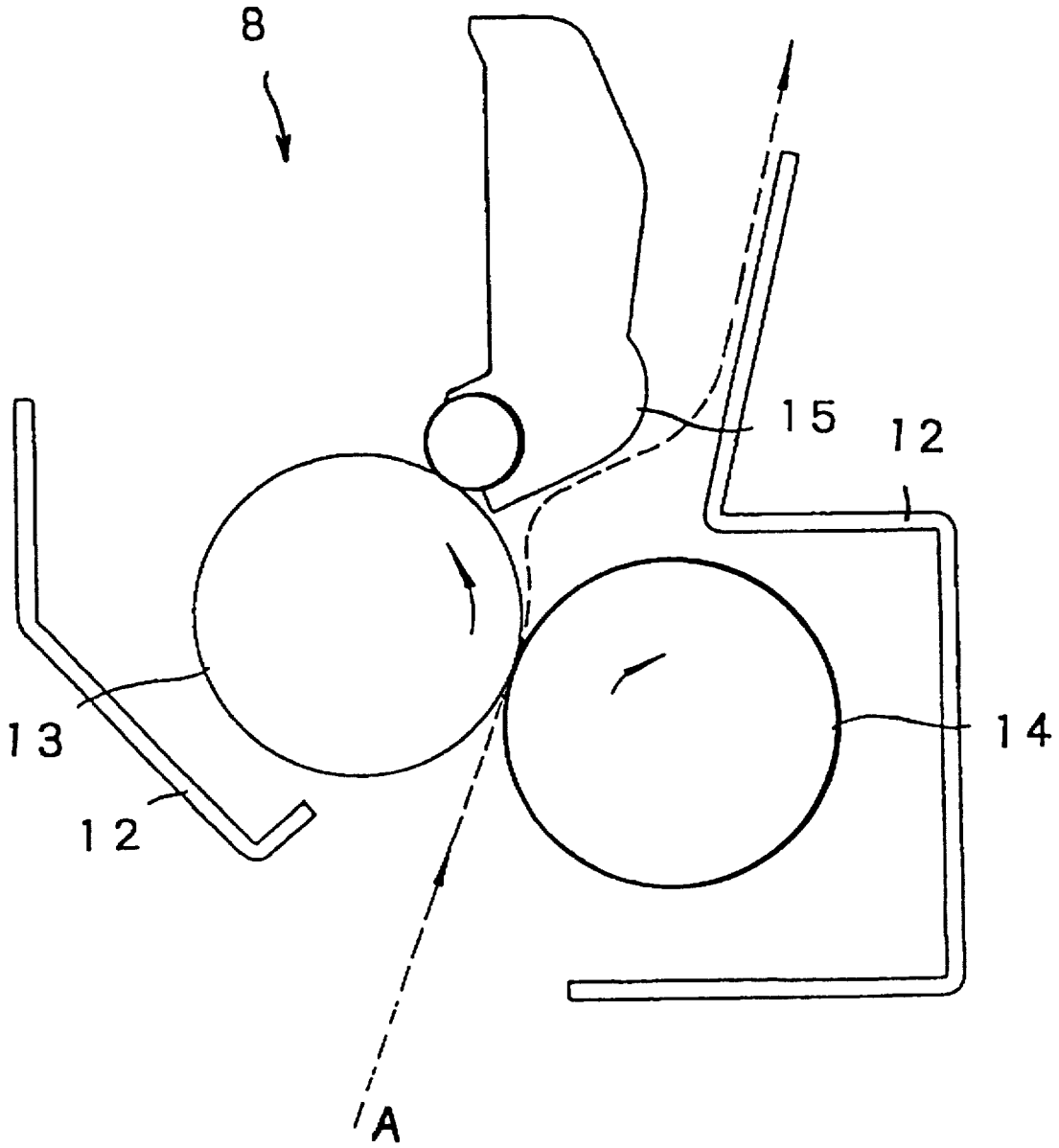
FIG. 2 is a view of the fixing device of FIG. 1

FIG. 2 is an illustration showing the fixing device 8 in FIG. 1 in detail. Inside a frame 12 of the fixing device 8, a fixing roller 13 and a pressure roller 14 are rotatably provided in a state of pressure contacting each other. The fixing roller 13 is driven to rotate by an unillustrated drive motor, and the pressure roller 14 rotates following thereto. The fixing roller 13 is formed by coating the surface of a metallic roller with a material promoting mold release and toner fixing, such as PTFE (polytetrafluoroethylene), PFA (fluorine resin which is copolymerized perfluoroalkoxitrifluoroethylenemononer and tetrofluoroethylenemonomer), or a resin compounded by blending PTFE and PFA, and heated by a heater lamp provided therein. Since the pressure roller 14 will be described in detail later, the description thereof is omitted at this stage.

The sheet having an unfixed toner image thereon by the transfer roller 7 is sent from location "A" in FIG. 2 and reaches a nip portion formed by the fixing roller 13 and the pressure roller 14. The sheet is transported while being gripped by the nip portion, and is heated by the fixing roller 13 as well as pressed by the pressure roller 14, thereby the unfixed toner image is fixed onto the sheet. The sheet on which the toner image has been fixed is separated from the surface of the fixing roller 13 by a separate claw 15 and is transported to a discharge roller 9 under the guidance of the guide surface of the frame 12.

Figure 3:
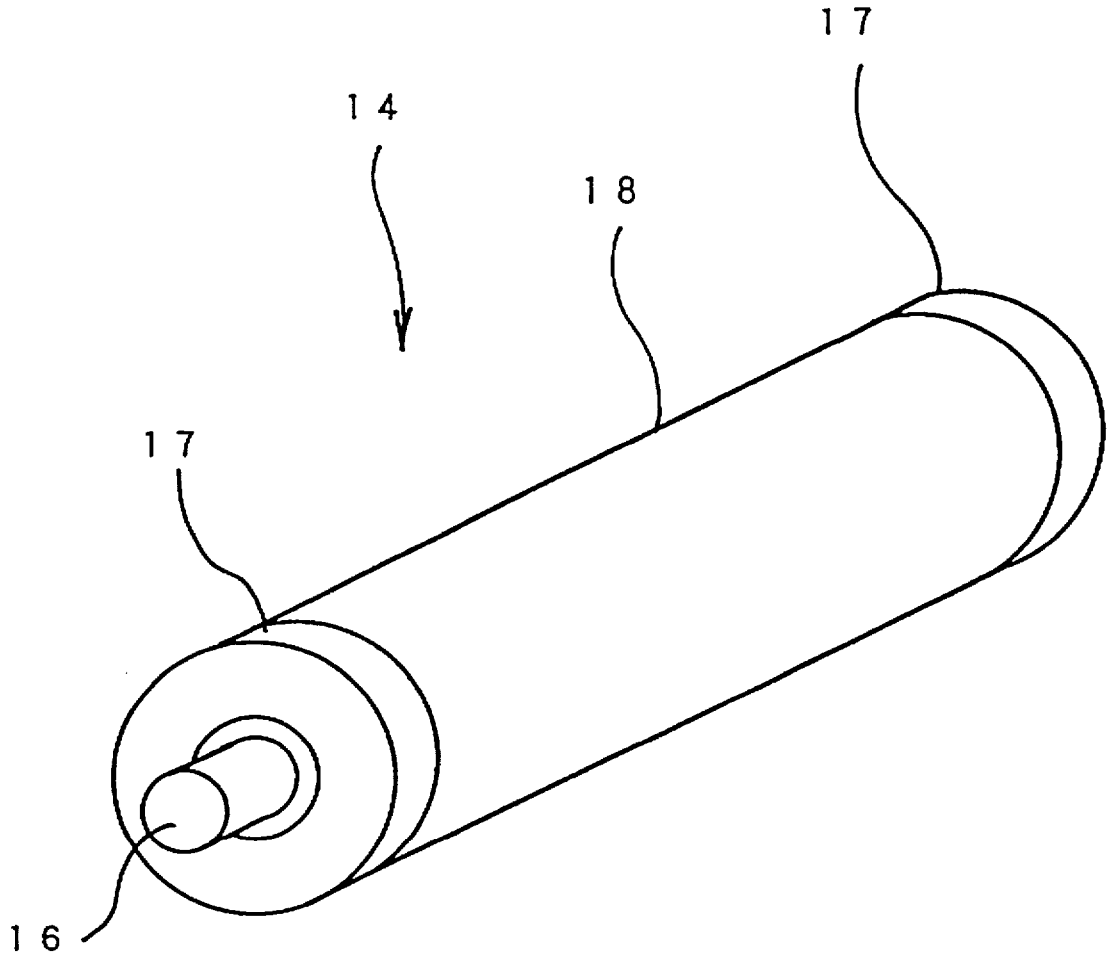
FIG. 3 is a perspective view of a pressure roller of the fixing device of the present invention.
Figure 4:
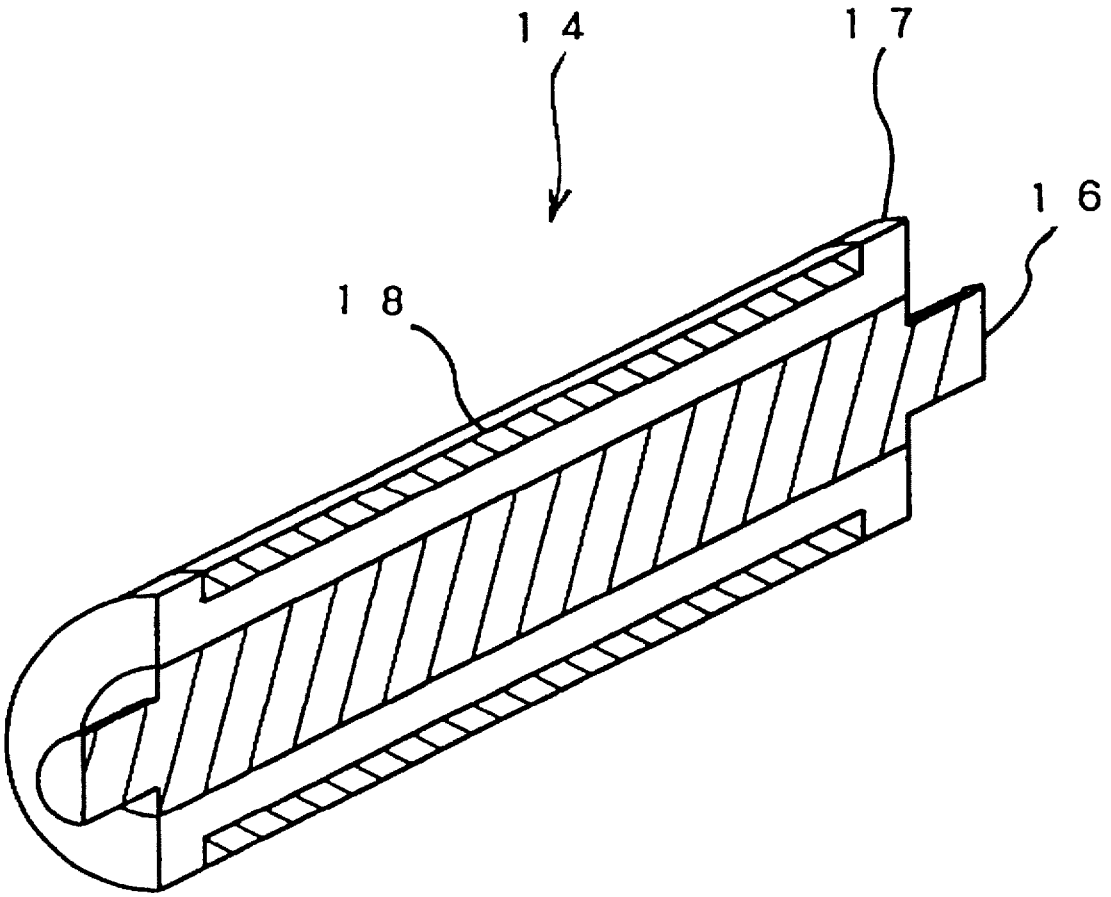
FIG. 4 is a cross section of the perspective view of the pressure roller of the fixing device of the present invention.

FIGS. 3 and 4 are a perspective view and a cross sectional view of the pressure roller 14, respectively.

In the pressure roller 14, heat resisting silicone sponge 17 is provided around a metal core 16. A mold release layer 18 of preferably 50 mm is formed by winding a PFA tube around the center portion of the outer surface of the heat resisting sponge 17. The PFA tube is not provided on both ends of the pressure roller 14 so that a coefficient of friction of the surface at both ends is higher than that of the mold release layer 18 of the center portion. Specifically, the roughness of the surface of the mold release layer 18 is about 0.03 mm, the roughness of the surface of the heat resisting sponge 17 of the end portion is about 2.0 mm, and the average roughness of the whole surface of the pressure roller 14 is about 0.4 mm.

Figure 5:
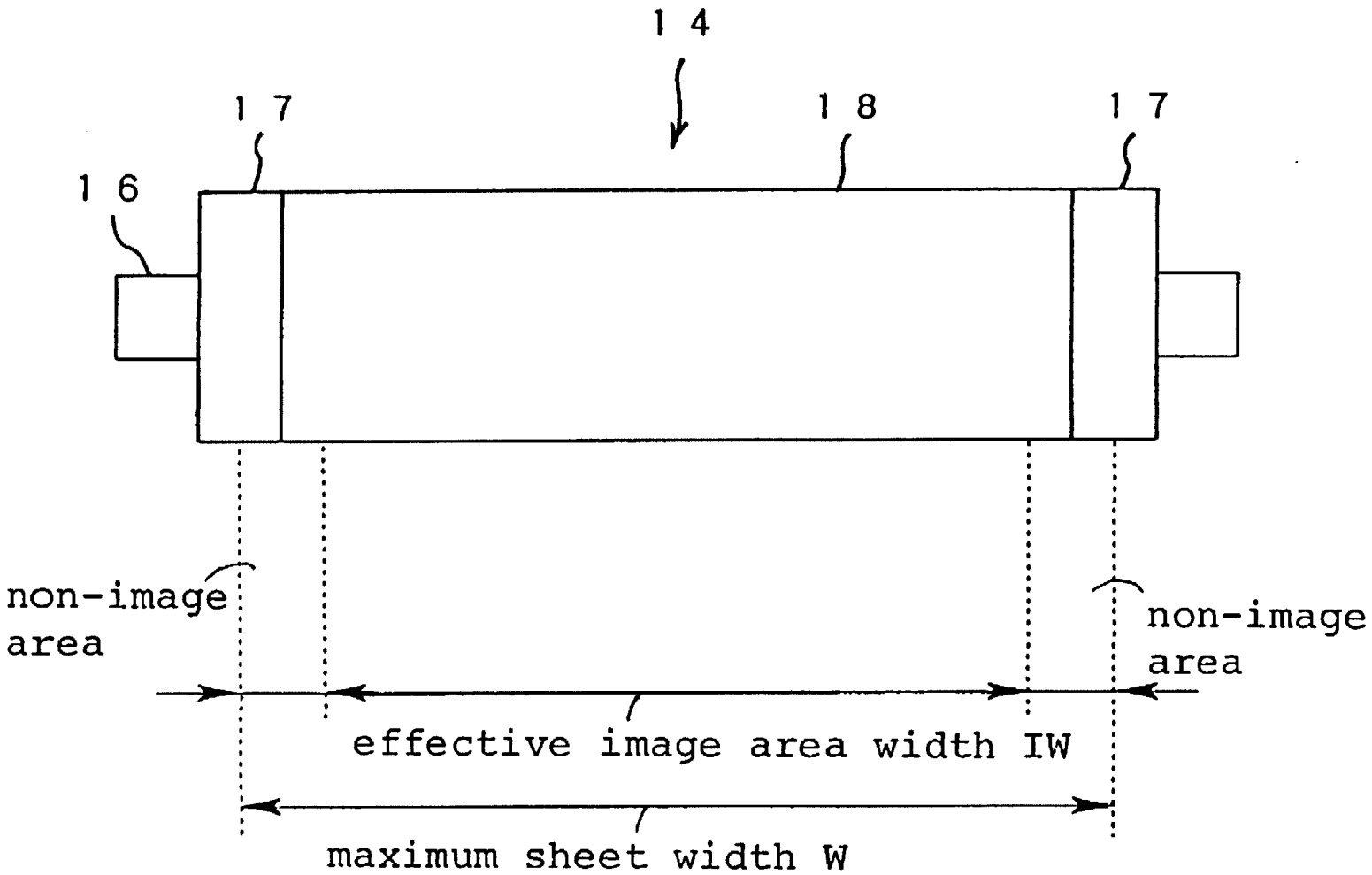
FIG. 5 is an illustration showing the relationship between the width of the pressure roller of the fixing device and the width of a sheet.

FIG. 5 is an illustration showing the relationship between the pressure roller 14 and the width of a sheet. "W" in the drawing shows a maximum sheet width possible to be printed by the printer of the present embodiment, and "IW" shows an effective image area width on a sheet. The effective image area width is an area on which an image is able to be formed. Generally, an image is not formed on both ends of a sheet, and the effective image area is a little narrower than the width of a sheet.

The fixing roller 13 and the pressure roller 14 are longer than the maximum sheet width W. The mold release layer 18 of the pressure roller 14 is provided all over the width direction of the effective image area, and the heat resisting sponge 17 is exposed to a nonimage portion of a sheet at both ends of the pressure roller 14.

Since the surface of the pressure roller 14 is formed with a material having a low coefficient of friction as well as excellent mold release in the effective image area as described above, even if toner on a sheet adheres to the fixing roller 13, there is little possibility that the toner on the fixing roller 13 will adhere to the pressure roller 14. Thus the rear surface of a sheet will not likely get dirty from toner. Further, since the surfaces of end portions of the pressure roller 14 are formed by a material of great coefficient of friction, even during fixing, the fixing roller 13 and the pressure roller 14 contact each other with great friction. Thus slippage does not occur between the fixing roller 13 and the pressure roller 14. Further, since the end surfaces of the pressure roller 14 have a great coefficient of friction contact with a sheet at the nonimage area, the sheet is sufficiently gripped and transported without influencing images.

Though heat resisting silicone sponge 17 is provided around a metal core 16 in the preferred embodiment, other heat resisting elastic material such as silicone rubber may be applied instead of sponge 17. Further, the mold release layer 18 may be formed by winding a PTFE tube, a tube of resin compounded by blending PTFE and PFA, or the like, instead of PFA tube as the preferred embodiment.

In the preferred embodiment, the surfaces of the end portions of the pressure roller 14 are formed by a material of great coefficient of friction. However, the aforedescribed structure of the pressure roller 14 is not limited to pressure rollers, but may also be used for the fixing roller. Or the surfaces of end portions of both fixing and pressure rollers may be formed by a material of great coefficient of friction.

Further, in the preferred embodiment, the diameters of the mold release layer 18 and the end portions 17 of the roller are the same. However, if the diameter of the end portions 17 is set a little larger than that of the diameter of the mold release layer 18, contact between the end portion 17 and a sheet in sheet feeding becomes more certain, the likelihood of slippage between a sheet and a roller is reduced, and the likelihood of a disorder of an image in fixing is substantially reduced.

Further, although both end portions of the pressure roller 14 are formed with a material of great coefficient of friction in the present embodiment, even if only one end portion of the roller is formed with such a material, the same effect as the present embodiment may be obtained. Needless to say, it is preferable to provide the material of great coefficient of friction at both end portions to assure the prevention of the slip between a roller and a sheet.

Further, the pressure roller 14 may be made from only one material, wherein the surface thereof has been treated such that the center portion of the surface is smoother than the outer portion to obtain the same effect as the present embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device comprising:

a rotatable first roller; and a second roller rotatably contacting with a surface of the first roller with pressure so as to fix an unfixed toner image onto a sheet when passing the sheet between the first and second rollers;

the second roller having a first portion provided on a peripheral surface thereof and including an image forming area and a second portion provided at each end of the first portion on the peripheral surface of the second roller, said second portions having a coefficient of friction greater than that of said first portion, the second roller including a sheet transport portion for contacting a transported sheet, the sheet transport portion including a part of the second portions.

2. The fixing device as claimed in claim 1, wherein lengths of said first and second rollers in an axial direction are longer than a maximum width of a sheet possible to be fed so that said second portions constantly contact with the surface of the first roller.

3. The fixing device as claimed in claim 1, wherein a diameter of said second portions is larger than that of said first portion.

4. The fixing device as claimed in claim 1 further comprising a heater and a motor, wherein said first roller is heated by the heater and rotatably driven by a motor, and said second roller rotates following rotation of said first roller.

5. The fixing device as claimed in claim 1, wherein:

the sheet has a maximum width and an effective image area width in a center portion of the sheet, lengths of said first and second rollers in an axial direction are longer than the maximum width, and a length of the first portion is longer than the effective image area width and shorter than the maximum width.

6. A fixing device comprising:

a pair of rollers which rotate with pressure contacting each other so as to fix an unfixed toner image onto a sheet by passing the sheet therebetween;

at least one of said rollers having a portion on a peripheral surface thereof outside an image forming area of the roller for forming an image on a sheet, the portion having a greater coefficient of friction than that of a remaining portion of the peripheral surface of the roller, said at least one of said rollers including a sheet transport portion for contacting a transported sheet, the sheet transport portion including a part of the portion having a greater coefficient of friction.

7. A fixing device comprising:

a rotatable first roller; and a second roller rotatably contacting with said first roller with pressure so as to fix an unfixed toner image onto a sheet when passing the sheet between the first and the second rollers;

at least one of said first and second rollers having at least one end portion on a peripheral surface thereof which has a diameter greater than that of a remaining portion of the peripheral surface.

8. The fixing device of claim 7, wherein the at least one roller has a first portion between the at least one end portion and a second end portion, and the second end portion has the same diameter as the at least one end portion, which diameter is greater than a diameter of the first portion.

9. The fixing device of claim 8, wherein:

the sheet has a maximum width and an effective image area width in a center portion of the sheet, lengths of said first and second rollers in an axial direction are longer than the maximum width, and a length of the first portion is longer than the effective image area width and shorter than the maximum width.

* * * * *